US010570602B2

(12) United States Patent
Holbrook

(10) Patent No.: US 10,570,602 B2
(45) Date of Patent: Feb. 25, 2020

(54) LOW PROFILE NESTABLE LEACHING CHAMBER HAVING INCREASED WATER STORAGE VOLUME

(71) Applicant: INFILTRATOR WATER TECHNOLOGIES, LLC, Old Saybrook, CT (US)

(72) Inventor: Paul Holbrook, Old Saybrook, CT (US)

(73) Assignee: INFILTRATOR WATER TECHNOLOGIES, Old Saybrook, CT (US)

( * ) Notice: Subject to any disclaimer, the term of this patent is extended or adjusted under 35 U.S.C. 154(b) by 67 days.

(21) Appl. No.: 15/954,235

(22) Filed: Apr. 16, 2018

(65) Prior Publication Data

US 2019/0316340 A1 Oct. 17, 2019

(51) Int. Cl.
*E02B 11/00* (2006.01)
*E02B 13/00* (2006.01)
*E03F 1/00* (2006.01)

(52) U.S. Cl.
CPC ..... *E03F 1/002* (2013.01)

(58) Field of Classification Search
CPC ..... E03F 1/002; E03F 1/003; E02B 11/00; E02B 11/005; B65D 88/76; B65D 88/06; Y02A 10/33
USPC ..... 405/36, 43, 46, 49
See application file for complete search history.

(56) References Cited

U.S. PATENT DOCUMENTS 5,419,838 A * 5/1995 DiTullio ..... E03B 11/14 210/747.3
5,773,756 A * 6/1998 DiTullio ..... E03B 11/14 174/37
7,413,381 B1 * 8/2008 Bracone, Jr. ..... E03F 1/003 405/43
2010/0329787 A1 * 12/2010 Moore, Jr. ..... E03F 1/003 405/49
2010/0329788 A1 * 12/2010 Moore, Jr. ..... E03F 1/003 405/49
2010/0329789 A1 * 12/2010 Coppes ..... E03F 1/003 405/49
2011/0020065 A1 * 1/2011 Moore, Jr. ..... E03F 1/003 405/49
2011/0293370 A1 * 12/2011 Moore, Jr. ..... E03F 1/003 405/43
2011/0293371 A1 * 12/2011 Moore, Jr. ..... E03F 1/003 405/49
2016/0281347 A1 * 9/2016 Miskovich ..... E04F 15/123

* cited by examiner

*Primary Examiner* — Frederick L Lagman
*Assistant Examiner* — Stacy N Lawson
(74) *Attorney, Agent, or Firm* — Steven M. McHugh

(57) ABSTRACT

A plastic chamber for collecting, receiving, detaining, or dispersing water when buried is provided and includes a support pillar having at least one pillar wall which defines a pillar cavity. Additionally, the chamber includes a plurality of chamber ends, a plurality of chamber side walls and a chamber top, wherein the chamber top includes a pillar opening and wherein the chamber defines a chamber internal cavity. It should be appreciated that the support pillar extends downwardly into the chamber internal cavity from the chamber top, wherein the pillar opening is communicated with the pillar cavity. The pillar cover is movably configurable between a first configuration and a second configuration to uncover and cover the least one pillar opening.

19 Claims, 21 Drawing Sheets

LOW PROFILE NESTABLE LEACHING CHAMBER HAVING INCREASED WATER STORAGE VOLUME

FIELD OF THE INVENTION

The present invention relates generally to low profile leaching chambers and more particularly to nestable low profile leaching chambers having an increased water storage volume.

BACKGROUND OF THE INVENTION

Leaching chambers made from thermoplastic materials are well known in the art and are widely used for receiving and dispersing wastewater, typically from a septic tank, into soil and other media. Such chambers typically have an arch shaped cross section defining a concave interior cavity having an open bottom, perforated sidewalls and a multiplicity of corrugations. Generally, these chambers store substantial quantities of wastewater within their concave interior cavity, thus provide a leaching area for dispersal of the wastewater by means of the chamber open bottom and perforations in the sidewalls. In fact, one of the performance objectives of the chambers is to provide an interior cavity that is large in order to contain as much wastewater as possible. The larger the interior cavity of the chamber is, the more wastewater that can be stored and dispersed into the surrounding soil.

Because these chambers are buried under soil, they need to have sufficient strength to support the overlying soil as well as other loads, such as motor vehicles which traverse the soil surface or other weighted objects that may be placed on the soil surface in proximity to the chamber. Accordingly, these chambers are typically designed to include certain physical characteristics that allow them to have the requisite strength while meeting certain performance objectives. These physical characteristics include wall (material) thickness, arch shaped cross section, corrugations and support pillars which extend downwardly into the interior cavity. However, one of the performance objectives is to allow one chamber to nest on top of a like chamber with a stack height that is within an acceptable range. This is because stack heights that are too high make the storage and transport of nested chambers less efficient because fewer chambers can be stacked within a given volume. Accordingly, in order for the chambers to be both nestable and include support pillars, the support pillars were made to have a hollow cavity. As such, when a first chamber is stacked on top of a like second chamber, the support pillars of the first chamber would be contained within the hollow cavity of the pillars of the like second chamber.

Unfortunately however, as the chambers are buried under overlying soil, the overlying soil enters and fills up the hollow cavity of the downward extending support pillars. This is undesirable because the presence of the support pillars filled with soil cause the available volume of the interior cavity of the chamber to be substantially reduced, thereby reducing the volume of wastewater that the chamber can contain and disperse.

SUMMARY OF THE INVENTION

A molded plastic chamber for collecting, receiving, detaining, or dispersing water when buried is provided and includes a support pillar, wherein the support pillar includes a pillar wall which defines a pillar cavity. The chamber further includes a plurality of chamber ends including a chamber first end and a chamber second end separated along a lengthwise direction by a chamber length and a plurality of chamber side walls including a first chamber side wall and a second chamber side wall separated along a widthwise direction by a chamber width which is perpendicular to the lengthwise direction. Additionally, the chamber includes a chamber top, wherein the chamber top includes a centering tab, a retaining tab and a pillar opening and wherein the chamber top, plurality of chamber ends and plurality of chamber side walls define a chamber internal cavity. The support pillar is associated with the chamber top such that the pillar wall extends downwardly from the chamber top and such that the pillar opening is communicated with the pillar cavity. The chamber also includes a pillar cover, wherein the pillar cover defines a cover opening and is movably associated with the chamber top to be configurable between a first configuration and a second configuration, wherein when in the first configuration, the cover opening is communicated with the pillar cavity, and wherein when in the second configuration, the pillar opening is covered by the pillar cover.

Furthermore, a plastic chamber for collecting, receiving, detaining, or dispersing water when buried is provided and includes at least one support pillar, wherein the at least one support pillar includes at least one pillar wall which defines at least one pillar cavity. Additionally, the chamber includes a plurality of chamber ends, a plurality of chamber side walls and a chamber top, wherein the chamber top includes at least one pillar opening and wherein the chamber top, plurality of chamber ends and plurality of chamber side walls define a chamber internal cavity. It should be appreciated that the at least one support pillar extends downwardly from the chamber top, and wherein the at least one pillar opening is communicated with the at least one pillar cavity. The chamber also includes a pillar cover, wherein the pillar cover defines at least one cover opening and is movably associated with the chamber top to be configurable between a first configuration and a second configuration, wherein when in the first configuration the at least one pillar cavity is associated with the at least one cover opening to be uncovered, and wherein when in the second configuration, the at least one pillar opening is covered by the pillar cover.

A method of implementing a leaching chamber having a hollow support pillar and a pillar cover configurable between a first configuration and a second configuration is provided and includes obtaining the leaching chamber having the pillar cover, wherein the pillar cover is configured in the first configuration. The method may also include nesting a like chamber with the leaching chamber such that the pillars of the like chamber are located within the pillar cavities of the leaching chamber and transporting and/or storing the leaching chamber and nested like chamber. The method may further include denesting the leaching chamber and the like chamber, configuring the pillar cover between the first configuration and the second configuration and locating the leaching chamber and/or like chamber within a hole and covering the leaching chamber and/or like chamber with soil.

BRIEF DESCRIPTION OF THE DRAWINGS

The foregoing and other features and advantages of the present invention should be more fully understood from the accompanying detailed description of illustrative embodiments taken in conjunction with the following Figures in which like elements are numbered alike in the several Figures.

DETAILED DESCRIPTION

As discussed hereinafter and in accordance with the present invention, a leaching chamber having one or more hollow support pillars is disclosed, wherein the chamber is designed to contain and/or store a larger wastewater volume than traditional low profile chambers while still having support pillars for strength and while still being able to efficiently nest with a like chamber during storage and transport by locating the support pillars of the like chamber within the support pillars of the chamber.

Figure 1:
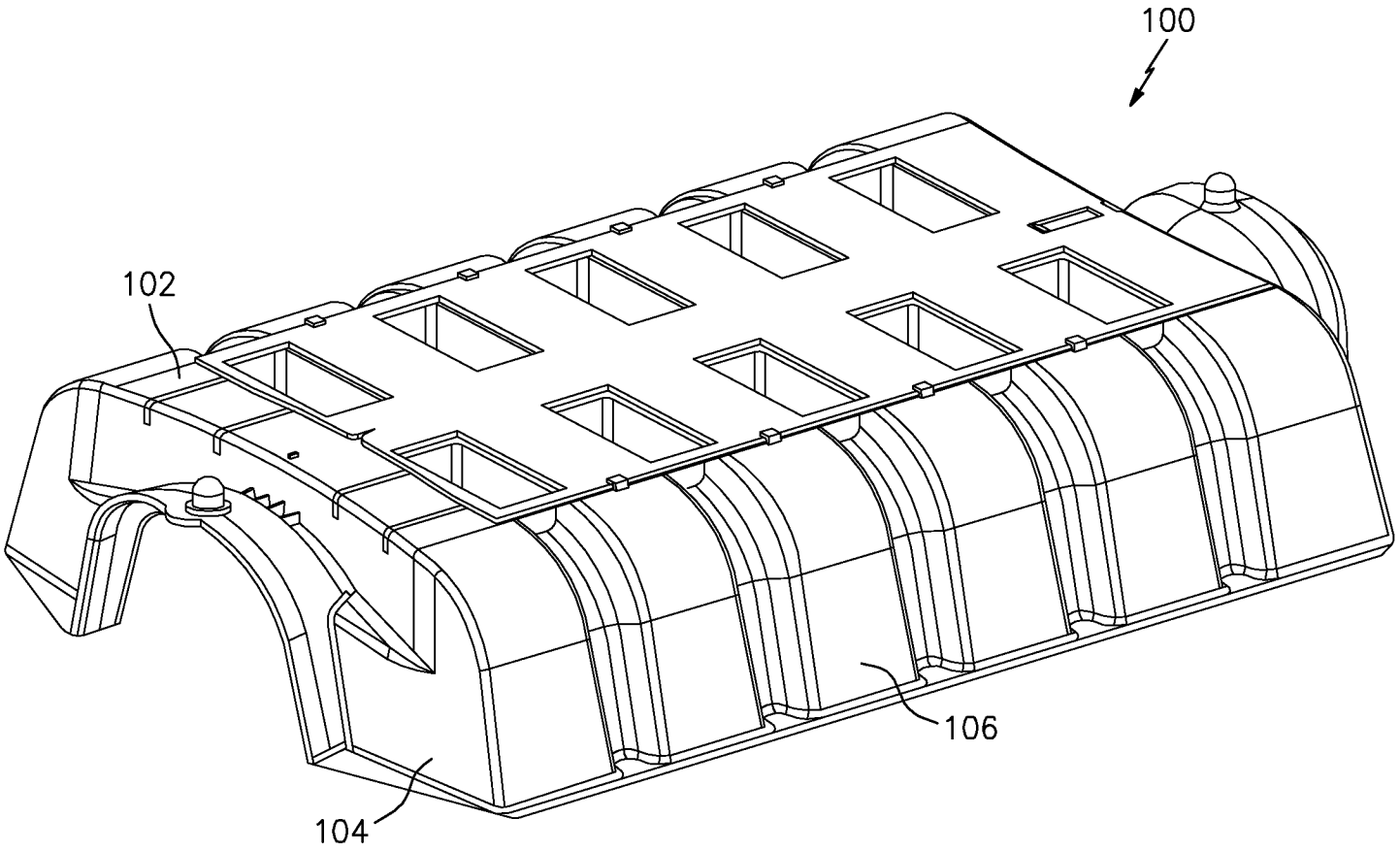
FIG. 1 top-down side isometric view of a low-profile leaching chamber having a plurality of pillars and a pillar cover, in accordance with one embodiment of the invention.
Figure 2:
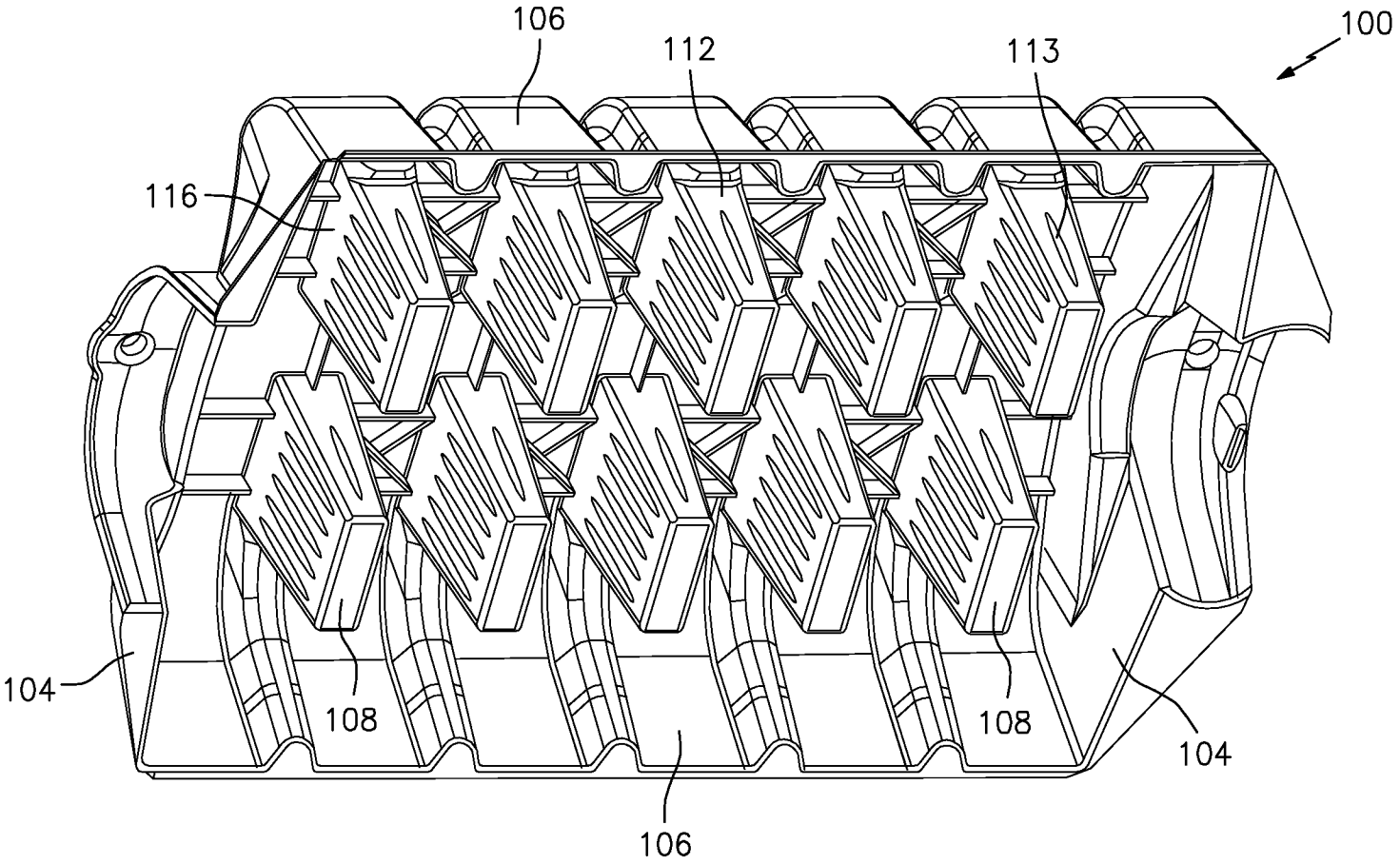
FIG. 2 is a bottom-up side isometric view of the leaching chamber of FIG. 1 showing the internal cavity and the plurality of support pillars.
Figure 3:
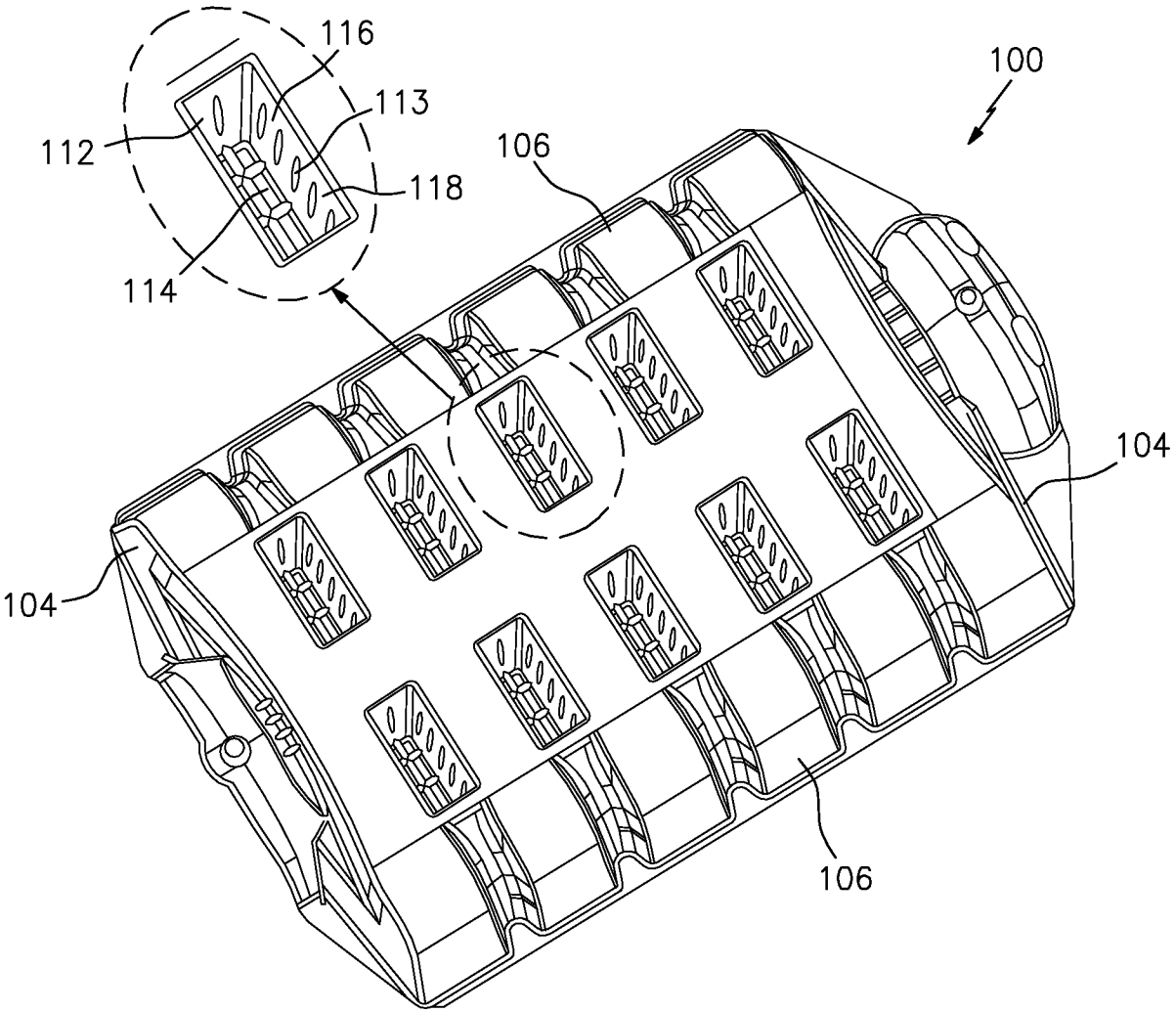
FIG. 3 is a top down view of the leaching chamber of FIG. 1.

Referring to FIG. 1, FIG. 2 and FIG. 3, a leaching chamber 100 having a chamber top 102, chamber ends 104, chamber side walls 106 and one or more support pillars 108 is provided, in accordance with one embodiment of the present invention, wherein the chamber top 102, chamber ends 104 and chamber side walls 106 define a chamber internal cavity 110. It should be appreciated that each of the one or more support pillars 108 include a pillar wall structure 112 which extends downwardly from the chamber top 102 into the chamber internal cavity 110, wherein the pillar wall structure 112 defines one or more wall openings 113 and defines a pillar cavity 114 such that each of the one or more pillars 108 are hollow. It is contemplated that the pillar wall structure 112 may be constructed from one or more pillar walls 116. The chamber top 102 further defines at least one pillar opening 118 for each of the one or more support pillars 108, wherein the at least one pillar opening 118 communicates the chamber top 102 with the pillar cavity 114 of each of the one or more support pillars 108.

Figure 4:
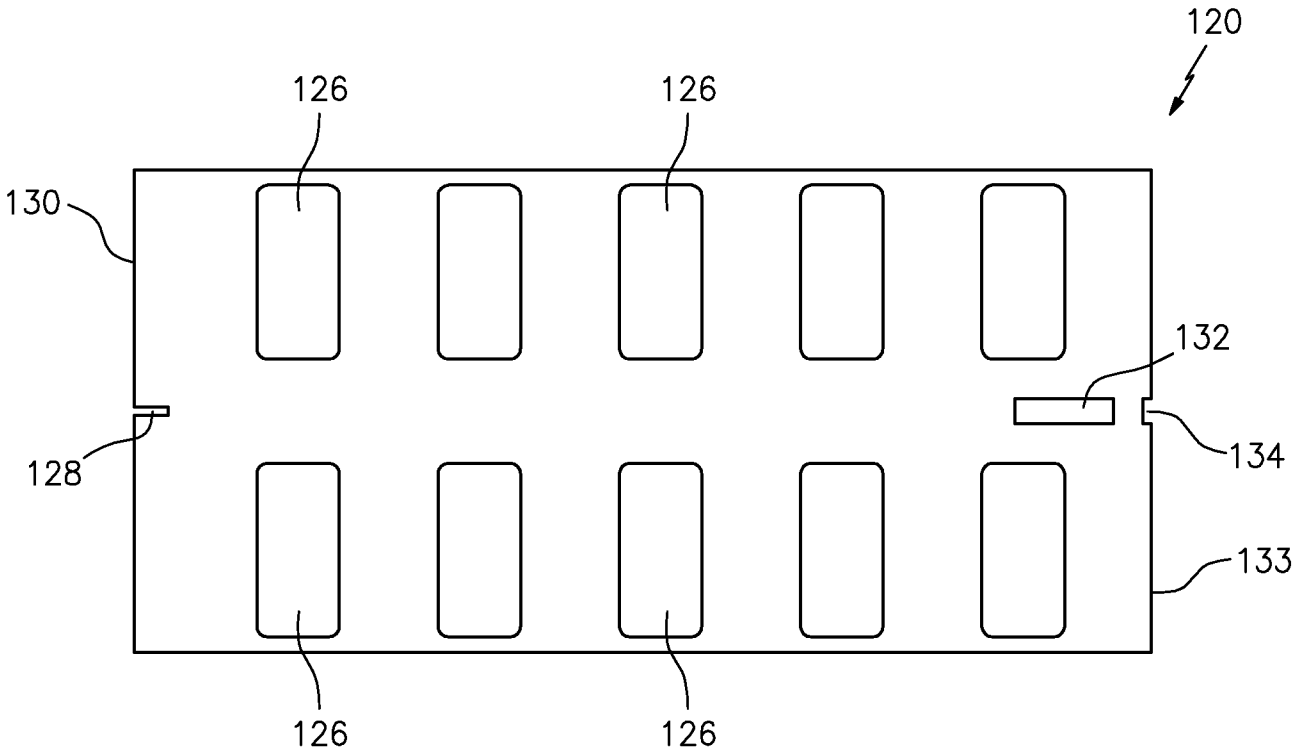
FIG. 4 is a top-down view of a pillar cover for use with the leaching chamber of FIG. 1, in accordance with one embodiment of the invention.
Figure 5A:
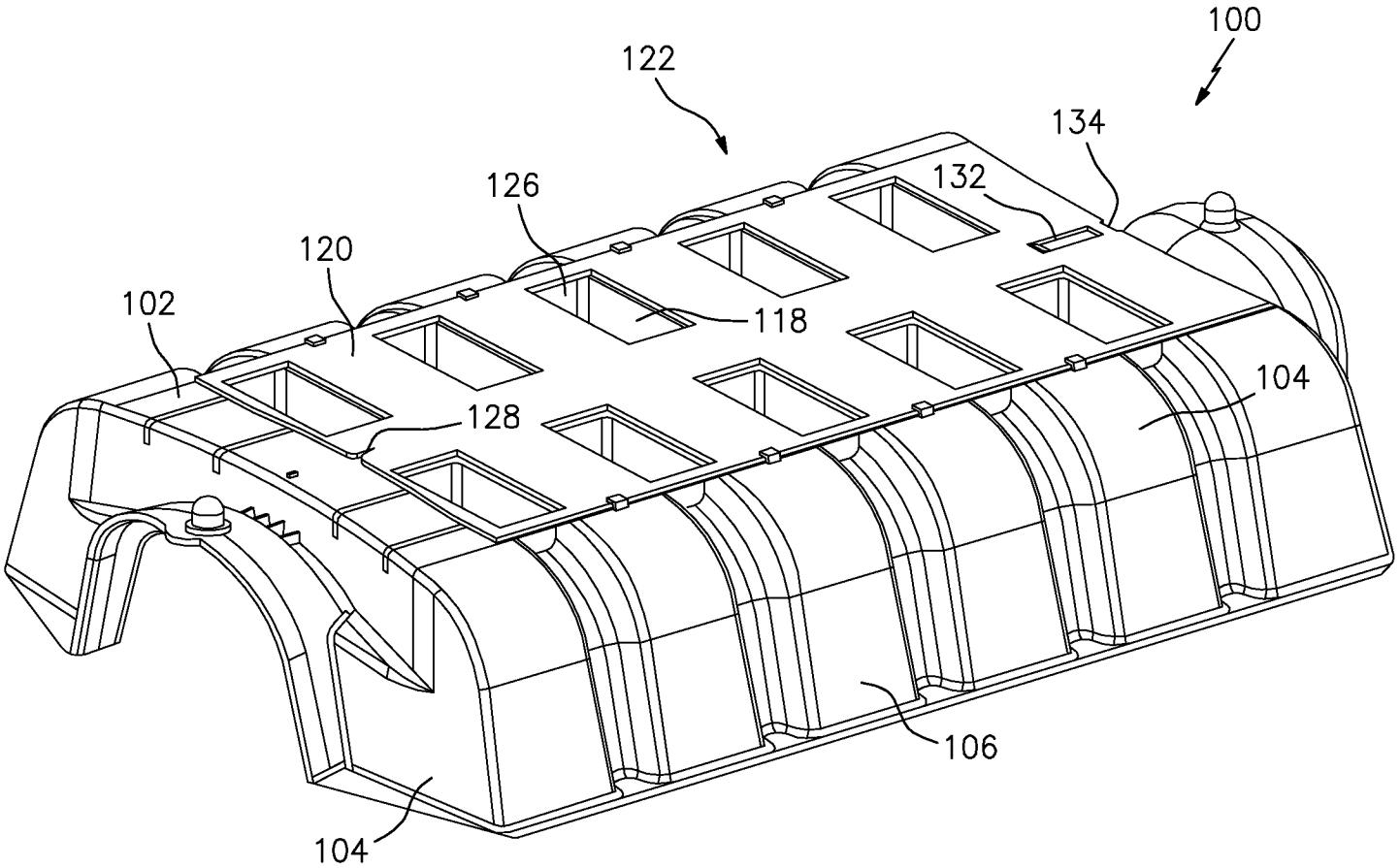
FIG. 5A shows a top-down side isometric view of the low-profile leaching chamber of FIG. 1 with the pillar cover configured into a first configuration, in accordance with one embodiment of the invention.
Figure 5B:
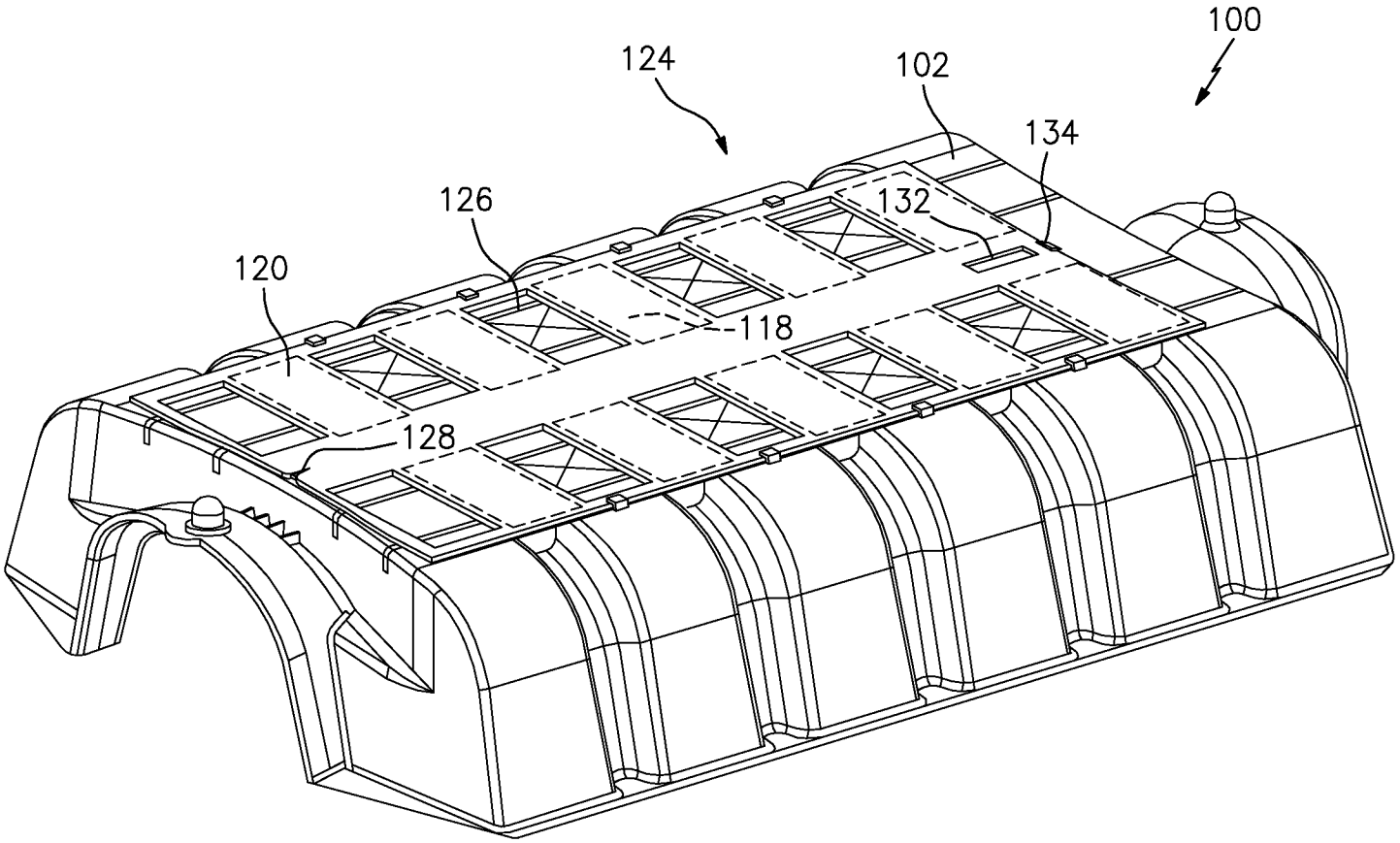
FIG. 5B shows a top-down side isometric view of the low-profile leaching chamber of FIG. 1 with the pillar cover configured into a second configuration, in accordance with one embodiment of the invention.

Referring to FIG. 4A, FIG. 5A and FIG. 5B, the leaching chamber 100 further includes a pillar cover 120, wherein the pillar cover 120 is movably associated with the chamber top 102 to be configurable between a first configuration 122 and a second configuration 124. Moreover, the pillar cover 120 includes at least one pillar cover opening 126 for each of the at least one pillar openings 118. As shown in FIG. 5A, when the pillar cover 120 is configured into the first configuration 122, each of the at least one pillar cover openings 126 is positioned adjacent to and aligned with one of each of the at least one pillar openings 118 to allow access to the pillar cavity 114 of each of the one or more support pillars 108. As shown in FIG. 5B, when the pillar cover 120 is configured into the second configuration 124, each of the at least one pillar cover openings 126 is positioned away from each of the at least one pillar openings 118 to deny access to the pillar cavity 114 of each of the one or more support pillars 108 thereby enclosing each of the pillar cavities 114. Additionally, the pillar cover 120 further includes a centering aperture or centering slot 128 located on a first cover end 130 of the pillar cover 120 and a retaining slot 132 located on a second cover end 133 of the pillar cover 120. Moreover, the pillar cover 120 also defines a cover tab cavity 134 located on the second cover end 133, wherein the cover tab cavity 134 is aligned with the retaining slot 132.

Figure 6:
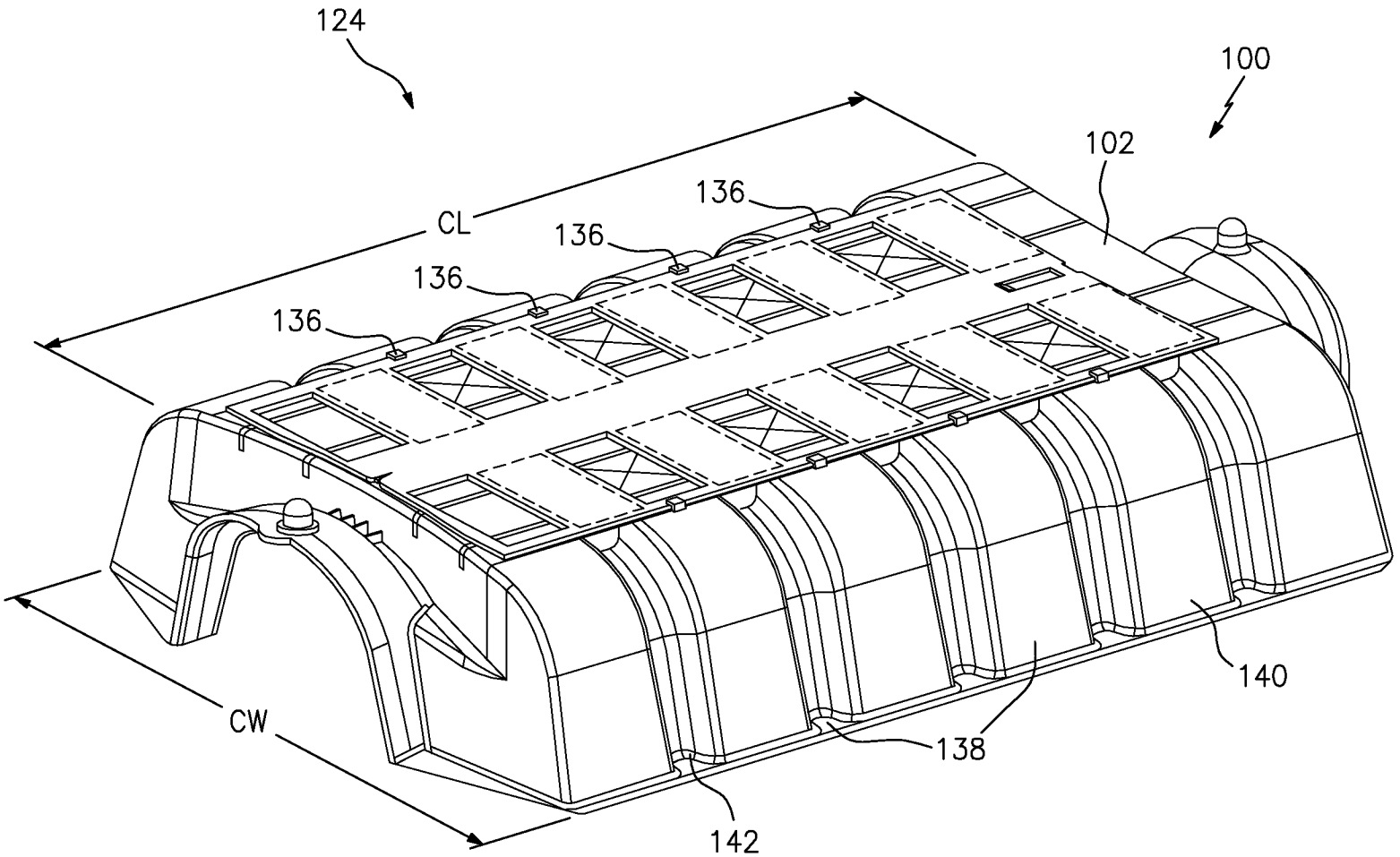
FIG. 6 shows a top-down side isometric view of the low-profile leaching chamber of FIG. 1.
Figure 7:
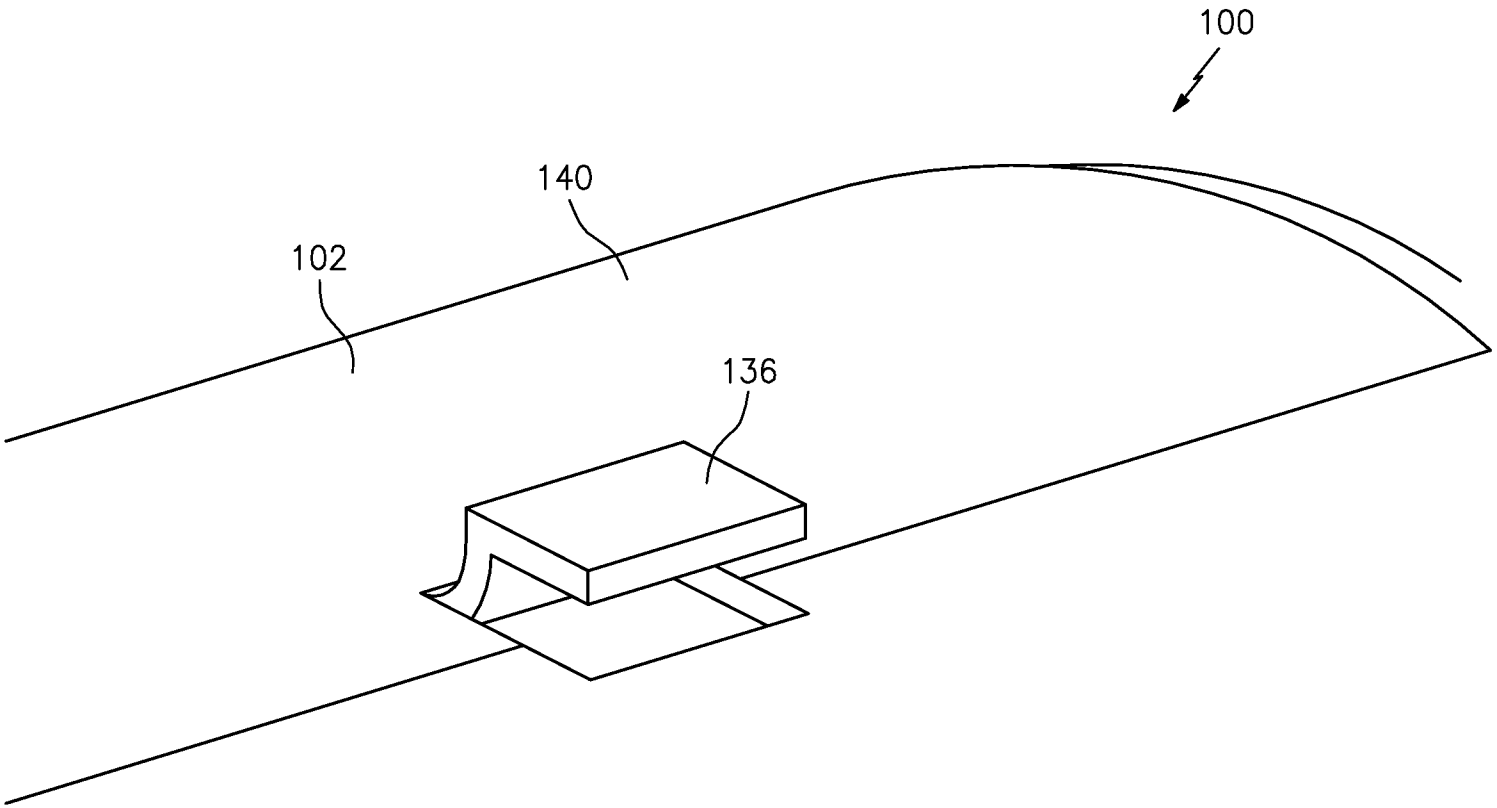
FIG. 7 shows a close-up view of a cover positioning tab for use on the leaching chamber of FIG. 1.
Figure 8:
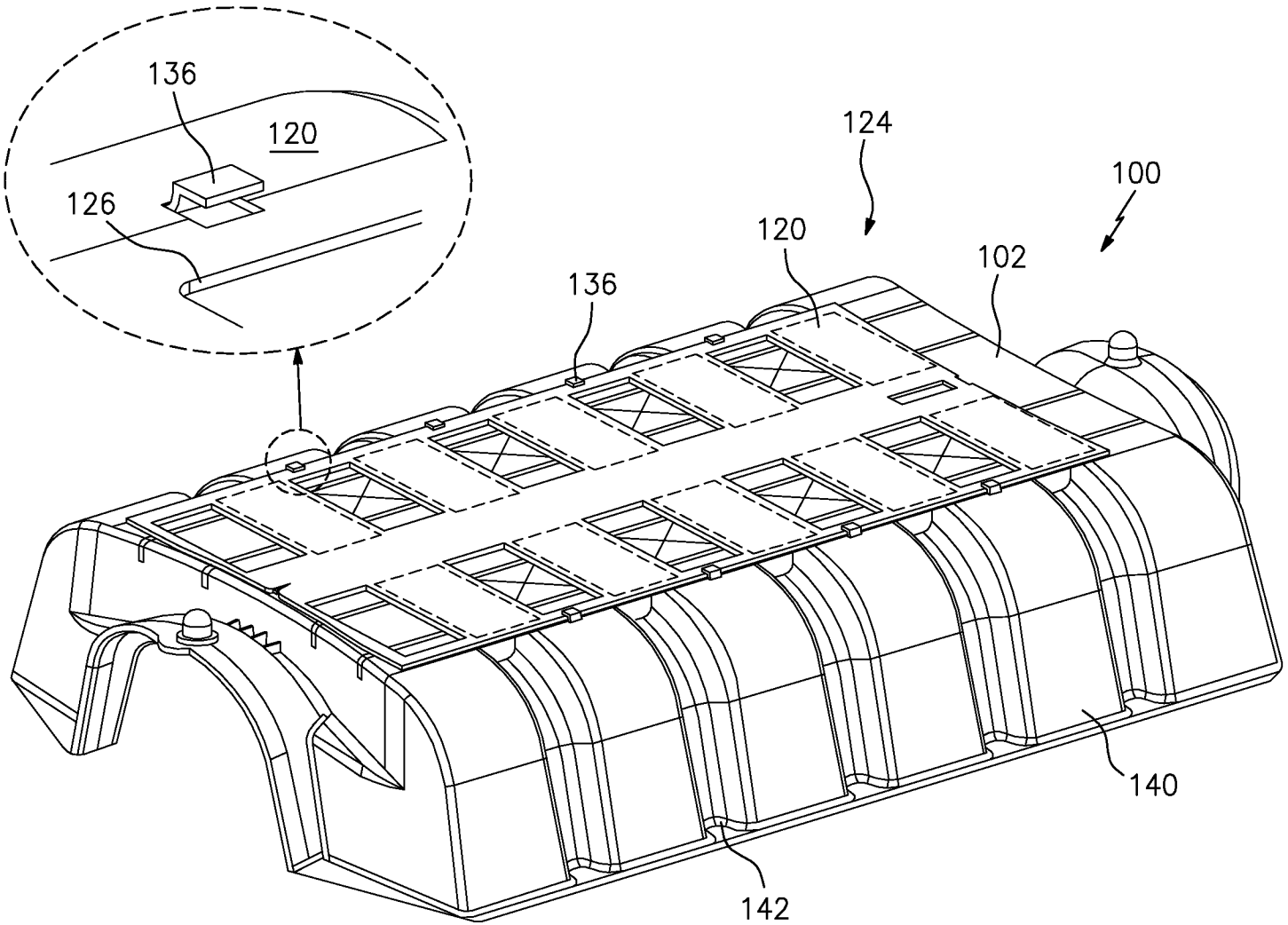
FIG. 8 shows a top-down side isometric view of the low-profile leaching chamber of FIG. 1 with the pillar cover configured into a second configuration and a close-up view of the interaction between the cover positioning tab and the pillar cover, in accordance with one embodiment of the invention.

Referring to FIG. 6, FIG. 7 and FIG. 8, the leaching chamber 100 further includes a chamber width CW, a chamber length CL and a plurality of cover positioning tabs 136 that are located on either side of the chamber top 102 and that are distributed along the chamber length CL. The plurality of cover positioning tabs 136 are configured to movably associate the pillar cover 120 with the chamber top 102 to allow the pillar cover 120 to be configurable between the first configuration 122 and the second configuration 124. Additionally, in one embodiment the leaching chamber 100 includes a plurality of corrugations 138 distributed along the chamber length CL which run traverse across (or at least partially across) the chamber width CW and which include a plurality of peak corrugations 140 and valley corrugations 142. It should be appreciated that one or more of the cover positioning tabs 136 are located on one or more of the peak corrugations 140 on both sides of the chamber top 102.

Figure 9:
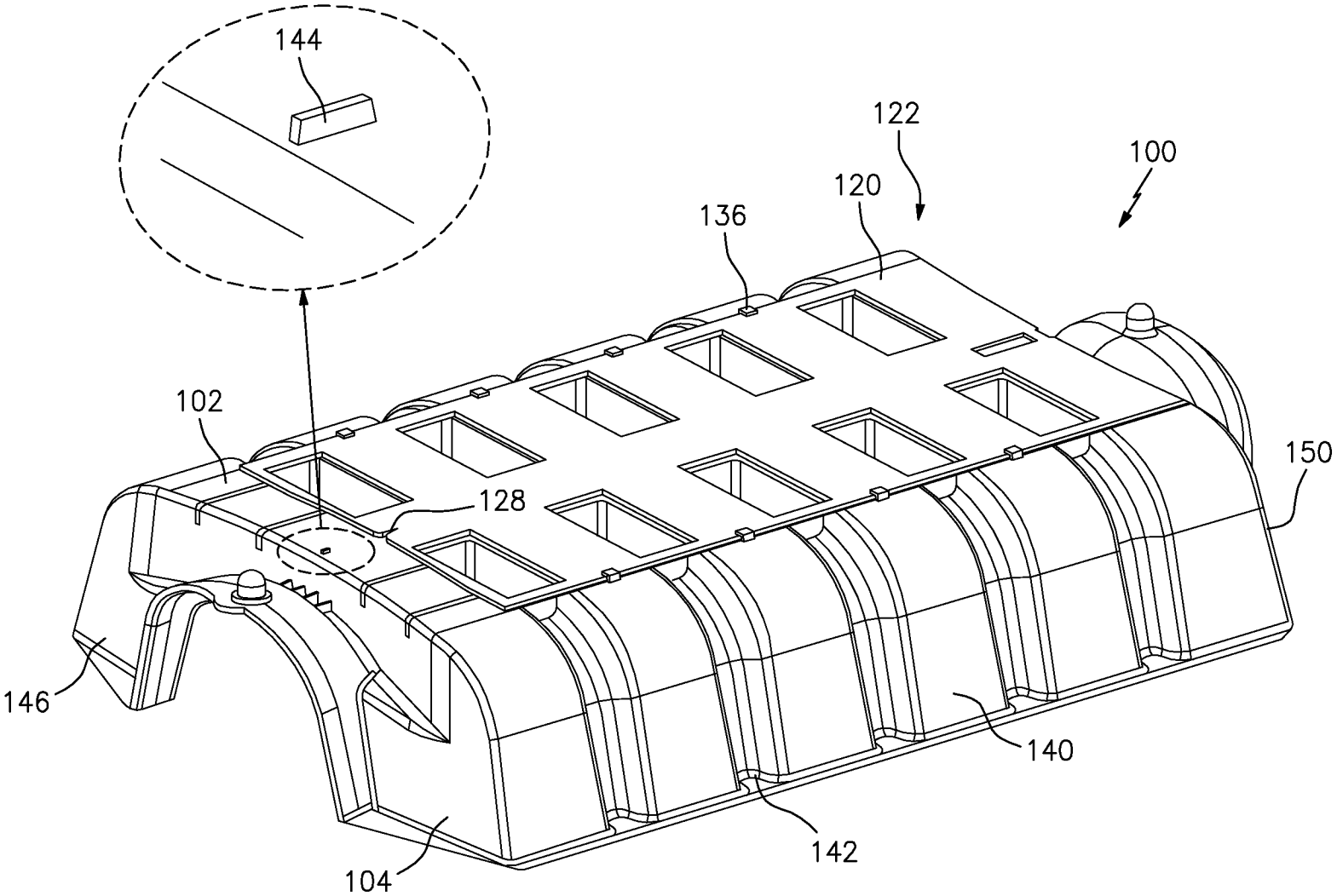
FIG. 9 shows a top-down side isometric view of the low-profile leaching chamber of FIG. 1 showing the centering tab on the chamber first end, in accordance with one embodiment of the invention.
Figure 10:
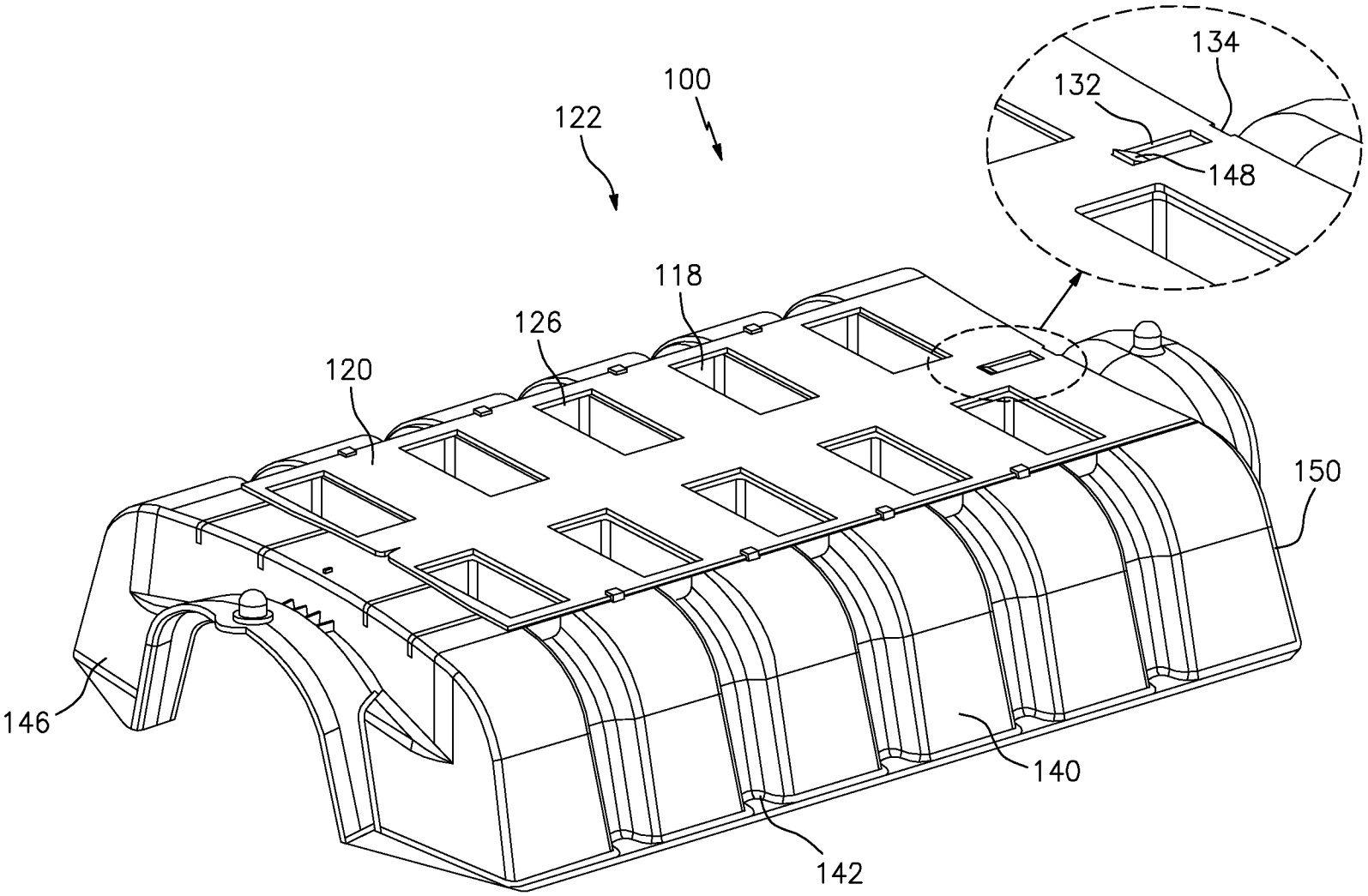
FIG. 10 shows a top-down side isometric view of the low-profile leaching chamber of FIG. 1 showing the retaining tab within the retaining slot on the chamber second end, in accordance with one embodiment of the invention.
Figure 11A:
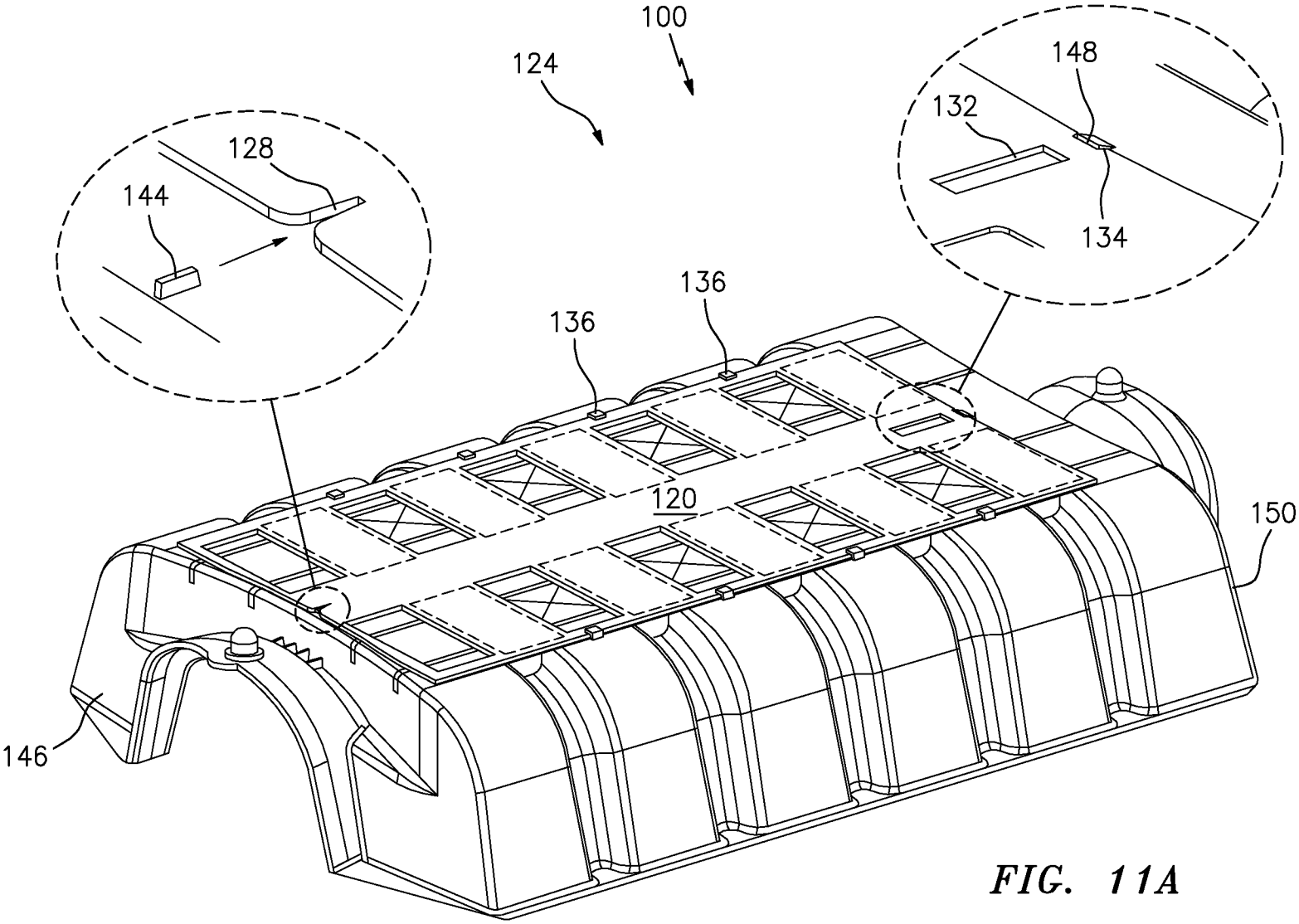
FIG. 11A shows a top-down side isometric view of the low-profile leaching chamber of FIG. 1 showing pillar cover in the second configuration with the centering tab within the centering slot and the retaining tab within cover tab cavity, in accordance with one embodiment of the invention.
Figure 11B:
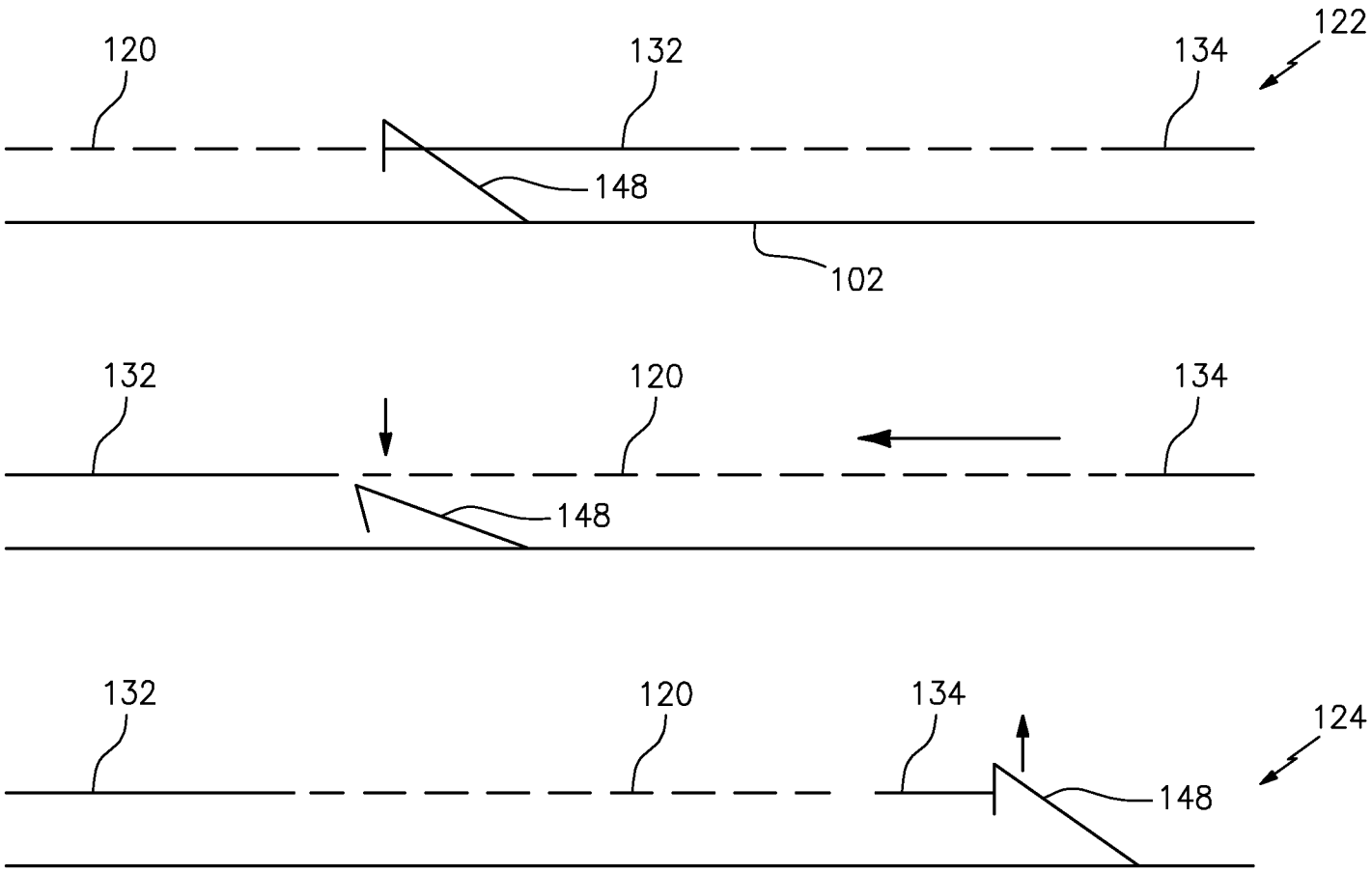
FIG. 11B shows a sectional side view of the interaction of the chamber top, the pillar cover and the retaining tab, in accordance with one embodiment of the invention.

Additionally, referring to FIG. 9 and FIG. 10, the leaching chamber 100 further includes a centering tab 144 located on a first chamber end 146 of the leaching chamber 100 and a retaining tab 148 located on a second chamber end 150 of the leaching chamber 100. It should be appreciated that the retaining tab 148 is springingly connected to the chamber top 102 to allow the retaining tab 148 to be compressible, wherein the retaining tab 148 is aligned with the retaining slot 132 and the cover tab cavity 134 when the pillar cover 120 is associated with the leaching chamber 100. Referring to FIG. 11A and FIG. 11B, in one embodiment, the retaining tab 148 is resiliently compressible and is angled in the direction of the first chamber end 146. As such, when the pillar cover 120 is slid toward the first chamber end 146, the edge of the retaining slot 132 engages and compresses the retaining tab 148. When the pillar cover 120 no longer covers the retaining tab 148, the resiliency of the retaining tab 148 causes the retaining tab 148 to decompress.

Referring again to FIG. 8, the pillar cover 120 is located to be adjacent to and movably associated with the chamber top 102 such that both sides of the pillar cover 120 are associated with the plurality of positioning tabs 136. It should be appreciated that in one embodiment, the cover positioning tabs 136 are substantially L-Shaped protrusions which extend up from the chamber top 102 that retain the pillar cover 120 adjacent the chamber top 102 while allowing the pillar cover 120 to slide along a portion of the chamber length CL between the first configuration 122 and the second configuration 124.

Figure 12:
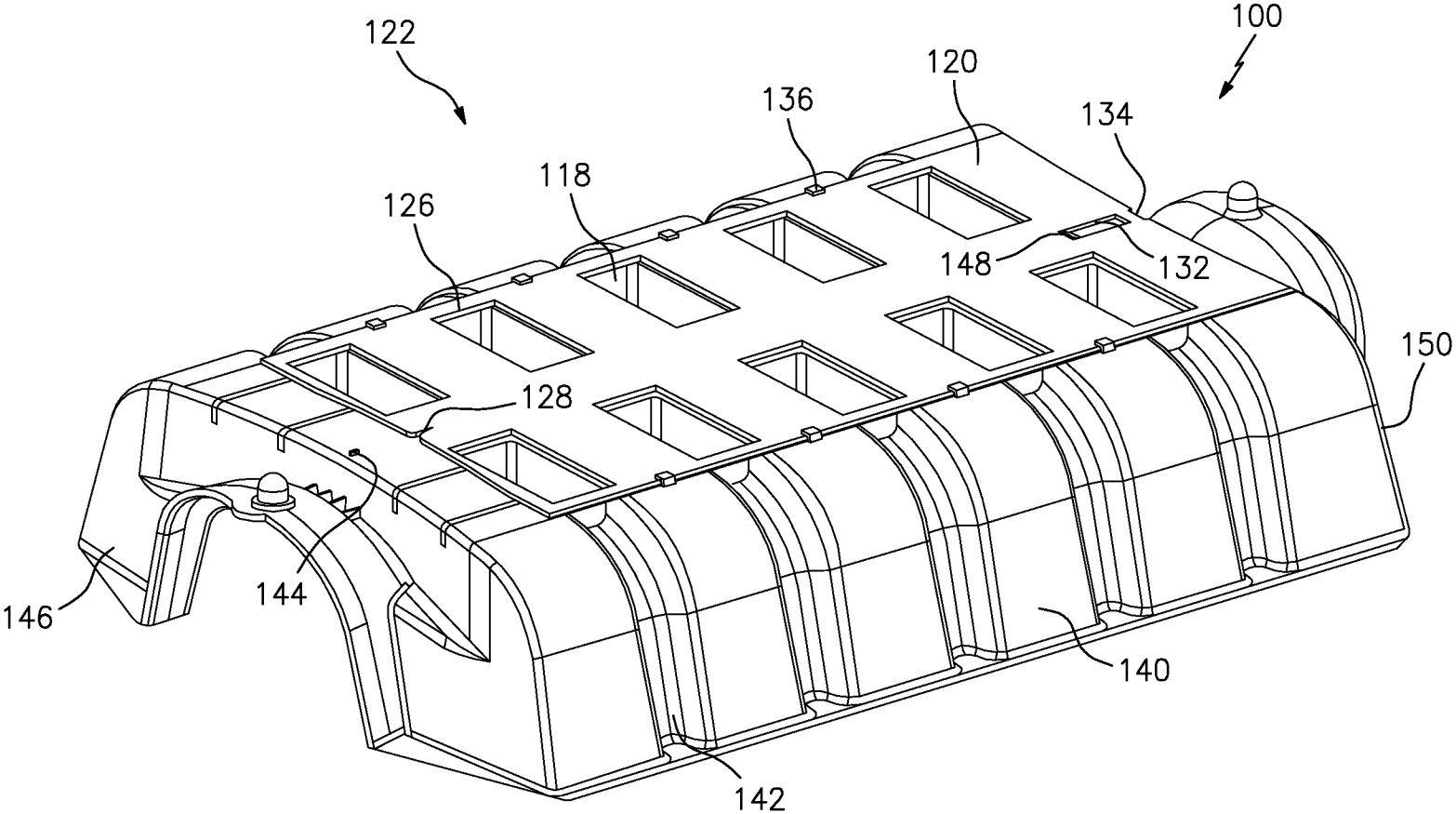
FIG. 12 shows a top-down side isometric view of the low-profile leaching chamber of FIG. 1 in the first configuration ready for nesting, storage and/or transport, in accordance with one embodiment of the invention.

Referring to FIG. 12, when the pillar cover 120 is configured into the first configuration 122, the leaching chamber 100 is configured for nesting, transport and/or storage. In this configuration, the pillar cover 120 is disposed such that the pillar cover openings 126 are adjacent to and located over the pillar openings 118 to allow access to the pillar cavities 114 via the pillar cover openings 126. Also, in this configuration the retaining tab 148 is located within the retaining slot 132 and the centering tab 144 is located away from the centering slot 128. As such, when a like chamber is nested with the leaching chamber 100, the pillars of the like chamber are located within the pillar cavities 114 of the leaching chamber 100 via the pillar cover openings 126. Similarly, a second (and/or more) like chamber may be nested with the first like chamber and so on.

Figure 13:
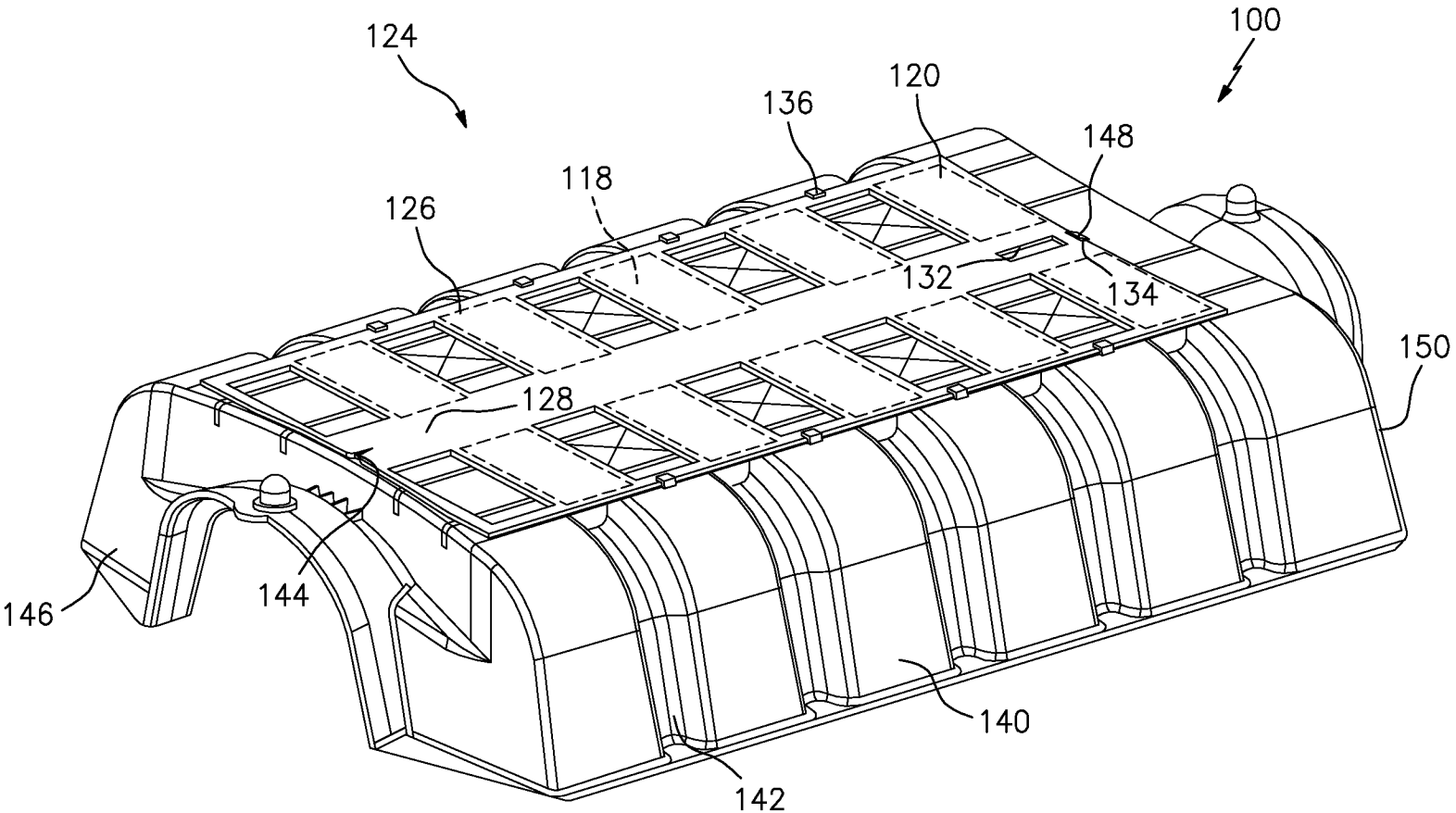
FIG. 13 shows a top-down side isometric view of the low-profile leaching chamber of FIG. 1 in the second configuration ready for installation, in accordance with one embodiment of the invention.

Referring to FIG. 13, when the pillar cover 120 is configured into the second configuration 124, the leaching chamber 100 is configured for installation. In this configuration, the pillar cover 120 is disposed such that the pillar cover openings 126 are located away from the pillar openings 118 to cover the pillar cavities 114 and to enclose the pillar cavities 114. Also, in this configuration the retaining tab 148 is located within the cover tab cavity 134 and the centering tab 144 is located within the centering slot 128.

It should be appreciated that the pillar cover 120 is configured from the first configuration 122 into the second configuration 124 as follows. As discussed above, when the pillar cover 120 is configured in the first configuration 122, the pillar cover openings 126 are located over the pillar openings 118 to allow access to the pillar cavities 114, the retaining tab 148 is located within the retaining slot 132 and the centering tab 144 is located away from the centering slot 128. Accordingly, the pillar cover 120 is located proximate the second chamber end 150. The pillar cover 120 is slid along the chamber length CL toward the first chamber end 146. As the pillar cover 120 traverses the chamber top 102, the pillar cover 120 engages the retaining tab 148 thereby compressing the pillar tab 148 and causing the pillar tab 148 to be located under the pillar cover 120. When the pillar cover 120 is located proximate the first chamber end 146, the pillar cover 120 is located over the pillar openings 118, the centering tab 144 becomes located within the centering slot 128 and the retaining tab 148 is no longer located under the pillar cover 120. The retaining tab 148 thus decompresses and becomes located within the cover tab cavity 134 thereby retaining the pillar cover 120 in the second configuration 150. Because the pillar openings 118 are covered by the pillar cover 120 and enclosed, as the leaching chamber 100 is covered with soil, no soil can enter the pillar cavities 114 and the entire volume of the pillar cavities 114 can be used for wastewater storage.

Figure 14A:
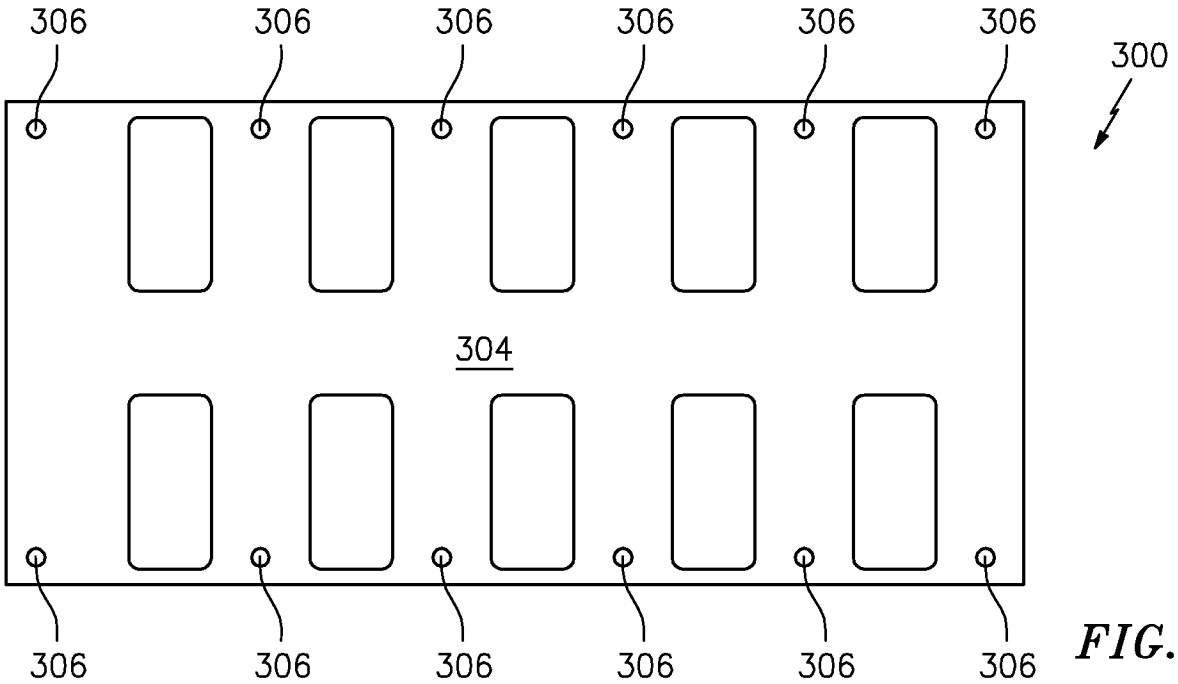
FIG. 14A shows a bottom-up view of pillar cover for use with a leaching chamber, in accordance with another embodiment of the invention.
Figure 14B:
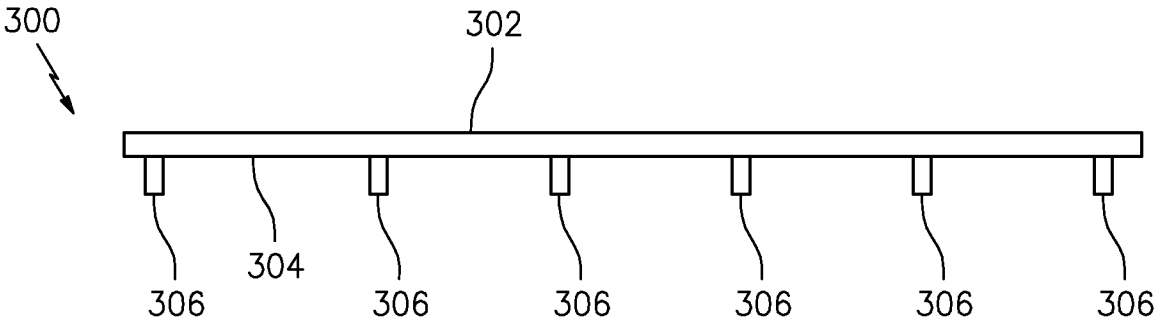
FIG. 14B shows a side view of the pillar cover of FIG. 14A.

Referring to FIG. 14A and FIG. 14B, it should be appreciated that another embodiment of a pillar cover 300 is provided, wherein the pillar cover 300 includes a pillar top 302, a pillar bottom 304 and one or more cover mounting tabs 306 which extend downward from the pillar bottom 304. In this embodiment, the pillar cover 300 may be used with a leaching chamber 100 having chamber cover mounting openings located in the chamber top 102. It should be appreciated that the chamber cover mounting openings may be molded into the chamber top 102 or the chamber cover mounting openings may be created (or retrofitted) in the chamber top 102 of existing chambers. Additionally, it is contemplated that the one or more cover mounting tabs 306 are configured to fit into the chamber cover mounting openings via a snap fit or press fit and the chamber cover mounting openings may be shaped and sized to snugly contain the one or more cover mounting tabs 306. Thus, after the leaching chambers 100 have been denested, the pillar cover 300 would be place on the chamber top 102 such that the cover mounting tabs 306 are contained within the chamber cover mounting openings. Accordingly, in this embodiment the pillar cover 300 may be shipped separately from the leaching chamber 100 and may be connected to the leaching chamber 100 prior to installation.

Figure 15:
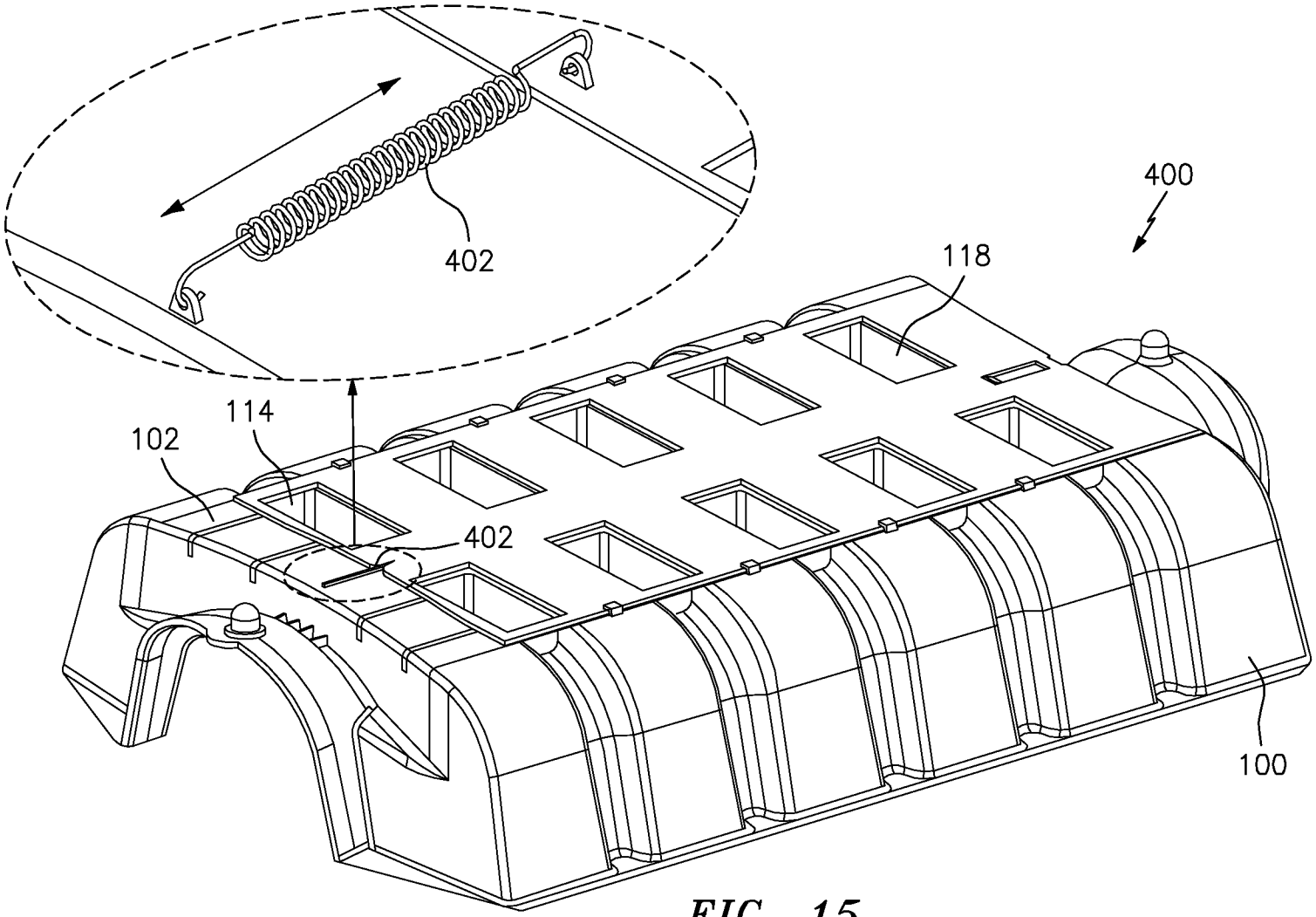
FIG. 15 shows a top-down side isometric view of a low-profile leaching chamber and a pillar cover, in accordance with still yet another embodiment of the invention.

Referring to FIG. 15, still yet another embodiment of a pillar cover 400 is provided, wherein the pillar cover 400 is movably associated with the leaching chamber 100 via a spring 402 or other resilient device. It should be appreciated that the pillar cover 400 is configurable between a first configuration and a second configuration, wherein when in the first configuration the pillar cover 400 is located away from the pillar openings 118 (i.e. the pillar openings 118 are uncovered) and when in the second configuration the pillar cover 400 is located over the pillar openings 118. The spring 402 is connected to the pillar cover 400 and to the leaching chamber 100 (such as to the chamber top 102) such that the pillar cover is springingly biased into the second configuration. As such, the leaching chambers 100 may be nested by configuring the pillar cover 400 into the first configuration and nesting a like chamber with the leaching chamber 100 so that the pillars of the like chamber are located in the pillar cavity 114 of the leaching chamber 100. The presence of the like chamber pillars will keep the pillar cover 400 in the first configuration. When the leaching chamber 100 and the like chamber are denested, the spring 402 will cause the pillar cover 400 to be configured into the second configuration and cover the pillar cavities 114.

Figure 16:
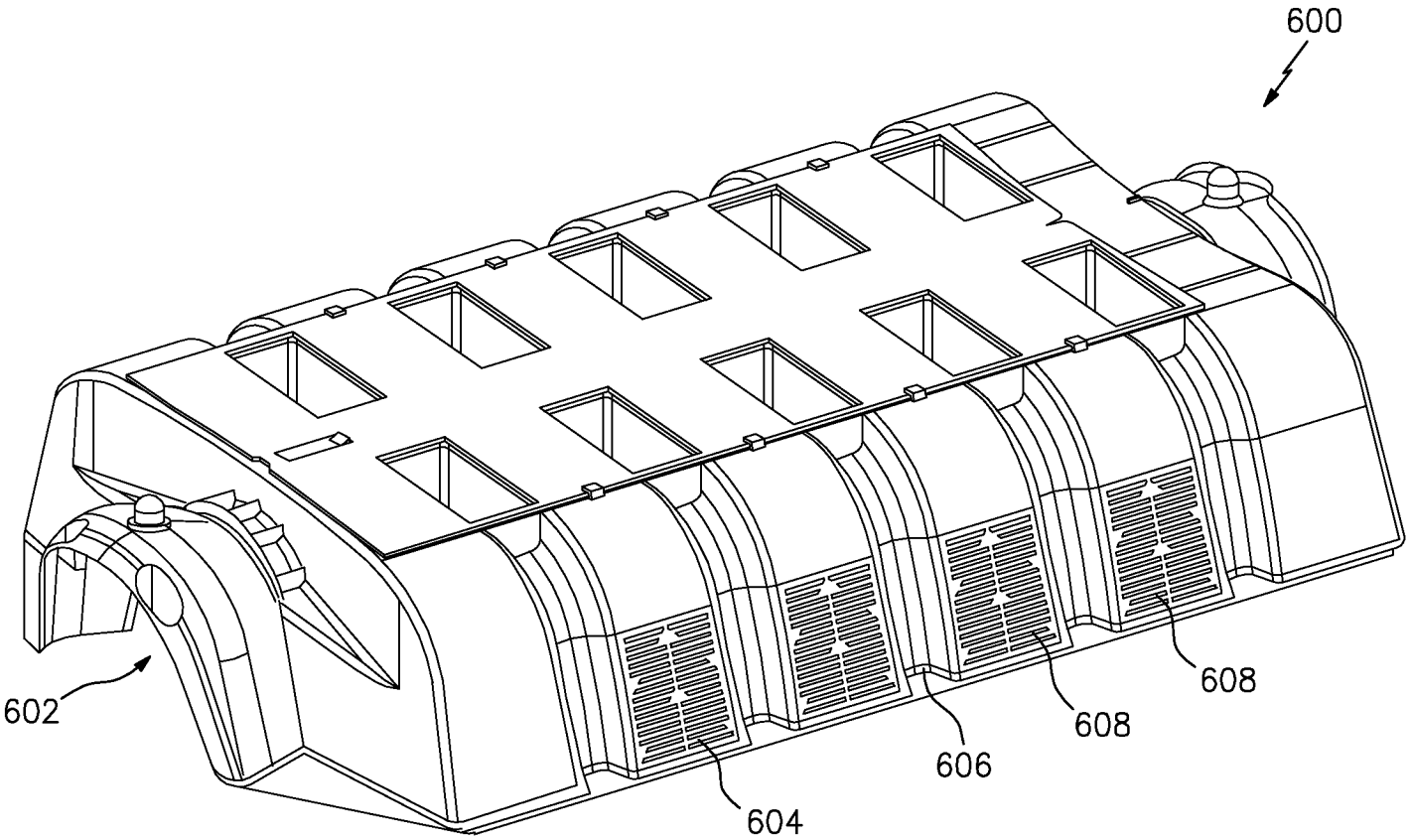
FIG. 16 shows a top-down side isometric view of the pillar cover of FIG. 1 being used with a low-profile leaching chamber.
Figure 17:
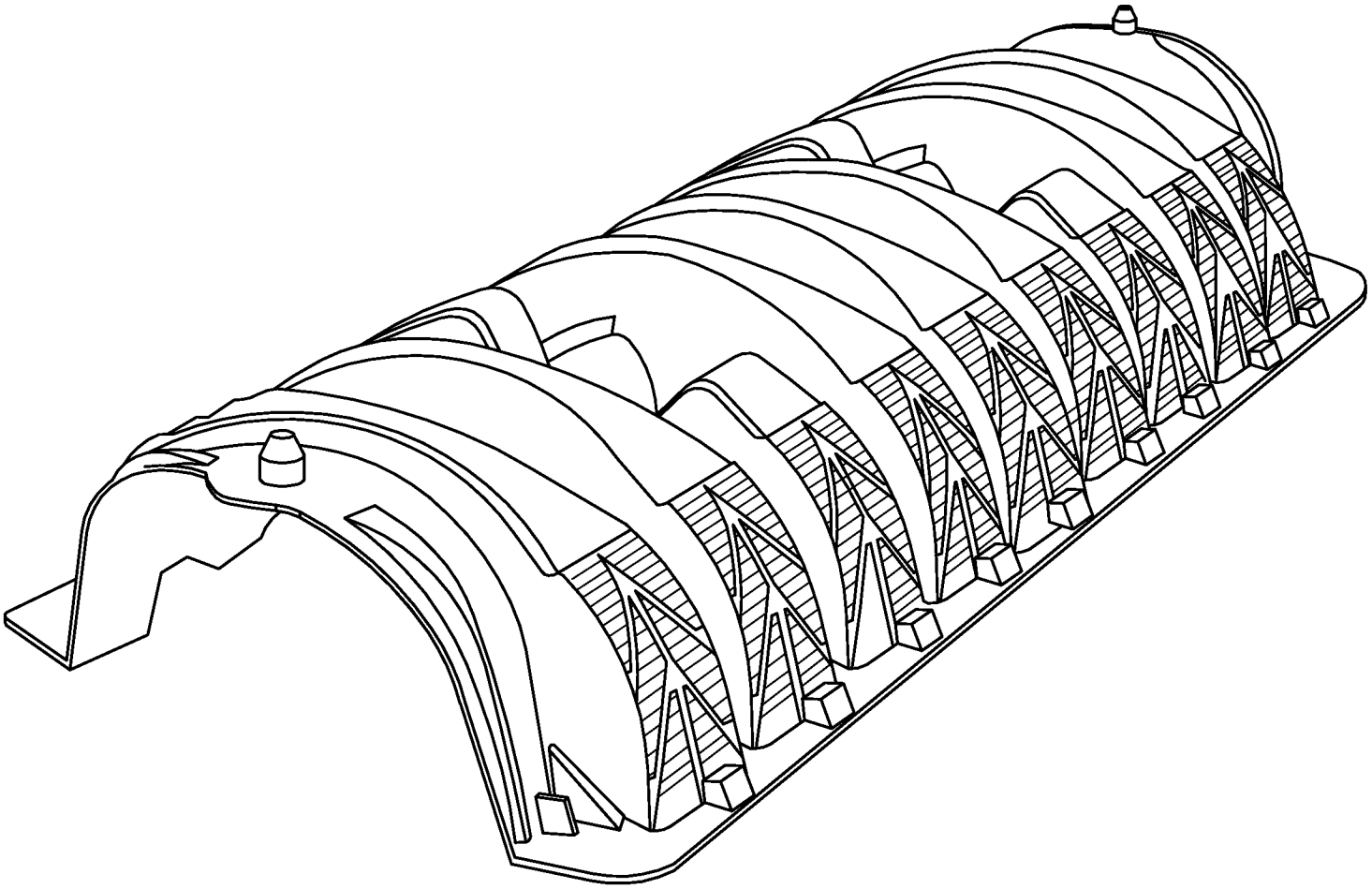
FIG. 17 shows a top-down side isometric view of one type of low-profile leaching chamber for use with the pillar cover of the invention.
Figure 18:
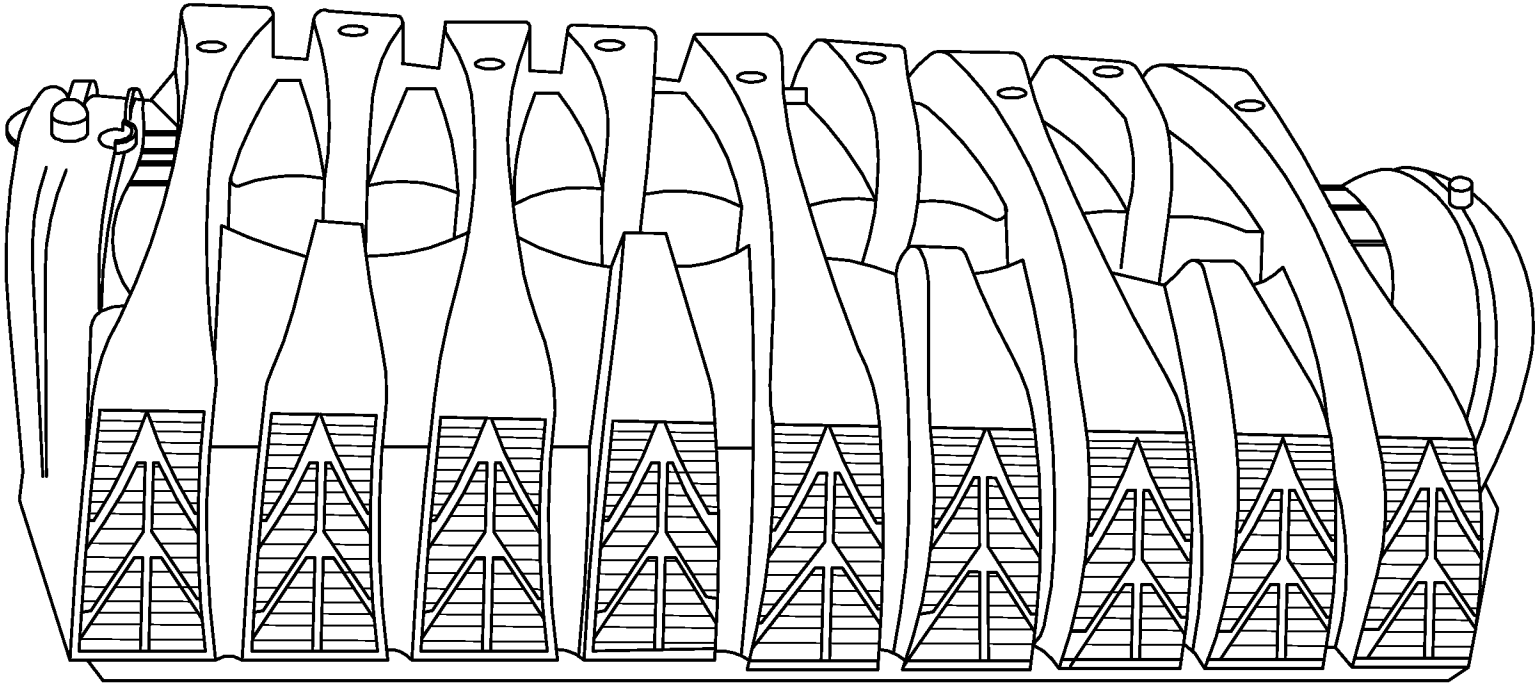
FIG. 18 shows a top-down side isometric view of another type of low-profile leaching chamber for use with the pillar cover of the invention.

It should be appreciated that leaching chamber 100 may be any nestable chamber having internal hollow pillars suitable to the desired end purpose. For example, referring to FIG. 16, it is contemplated that the leaching chamber may be a low profile chamber 600 having a chamber cavity 602, peak corrugations 604, valley corrugations 606, side wall openings 608 and internal hollow pillars that extend down into the chamber cavity 602 and wherein the sidewall openings 608 may be located on the peak corrugations 602 and/or valley corrugations 604 and distributed along the length of the chamber 600. It should be appreciated that the sidewall openings 608 act to disburse wastewater contained within the chamber cavity 602 into the surrounding soil. One such chamber type would be the Quick4® Plus Equalizer 36 Low Profile (LP) chamber (See FIG. 17) or the Quick4® Plus Standard Low Profile (LP) chamber (See FIG. 18).

Figure 19:
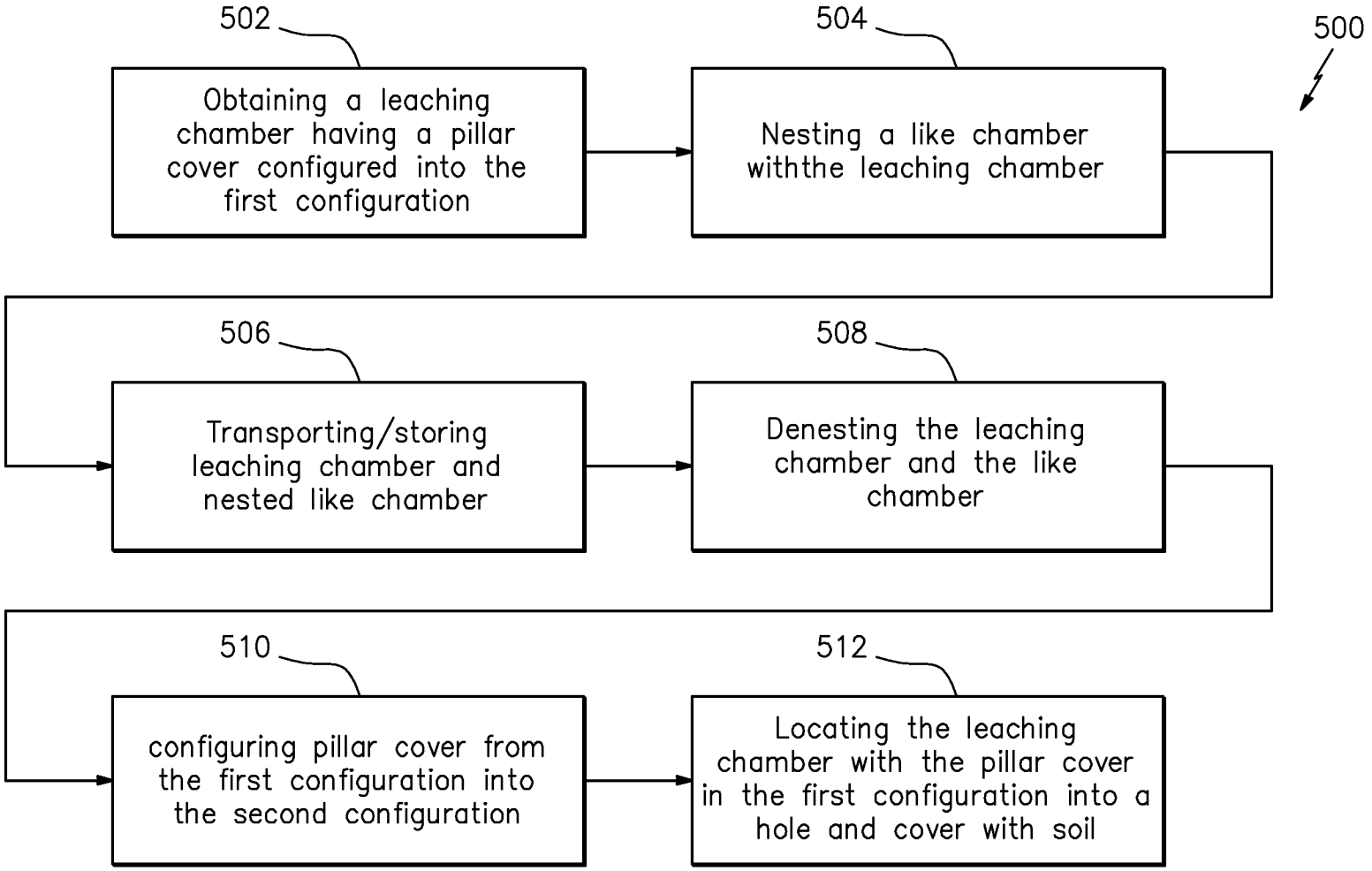
FIG. 19 is an operational block diagram illustrating a method for implementing a leaching chamber having one or more support pillars and a pillar cover configurable between a first configuration and a second configuration, in accordance with one embodiment of the invention.

In accordance with an additional embodiment of the invention, referring to FIG. 19, an operational block diagram illustrating a method 500 for implementing a leaching chamber 100 with one or more support pillars 108 and a pillar cover 120 is provided, wherein the pillar cover 120 is configurable between a first configuration 146 and a second configuration 150. The method 500 includes obtaining the leaching chamber 100 having the pillar cover 120, wherein the pillar cover 120 is configured into the first configuration 146, as shown in operational block 502. The method 500 may further include nesting a like chamber 200 with the leaching chamber 100 such that the pillars of the like chamber 200 are located within the pillar cavities 114 of the leaching chamber 100, as shown in operational block 504. The method may also include transporting and/or storing the leaching chamber 100 and nested like chamber 200, as shown in operational block 506. When the leaching 100 and/or nested like chamber is ready for use, the leaching chamber 100 and nested like chamber 200 are 'denested', as shown in operational block 508. The method 500 further includes sliding the pillar cover 120 toward the first chamber end 146, such that the centering tab 144 becomes located within the centering slot 128 and the retaining tab 148 becomes located within the cover tab cavity 134, as shown in operational block 510. Moreover, the method 500 may also include locating the leaching chamber 100 and/or like chamber 200 within a hole and covering the leaching chamber 100 and/or like chamber 200 with soil, wherein the leaching chamber 100 and/or like chamber 200 are configured into the first configuration 146, as shown in operational block 512.

It should be further appreciated that the pillar cover 100 may be constructed from any material suitable to the desired end purpose, such as a metal, a composite material and/or a thermoplastic material, such as polypropylene or high density polyethylene.

While the invention has been described with reference to an exemplary embodiment, it should be understood by those skilled in the art that various changes may be made and equivalents may be substituted for elements thereof without departing from the scope of the invention. Moreover, the embodiments or parts of the embodiments may be combined in whole or in part without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

I claim:

1. A molded plastic chamber for collecting, receiving, detaining, or dispersing water when buried, the chamber comprising:

a support pillar, wherein the support pillar includes a pillar wall which defines a pillar cavity;

a plurality of chamber ends including a chamber first end and a chamber second end separated along a lengthwise direction by a chamber length;

a plurality of chamber side walls including a first chamber side wall and a second chamber side wall separated along a widthwise direction by a chamber width which is perpendicular to the lengthwise direction;

a chamber top, wherein the chamber top includes a centering tab, a retaining tab and a pillar opening and wherein the chamber top, plurality of chamber ends and plurality of chamber side walls define a chamber internal cavity, and wherein the support pillar is associated with the chamber top such that the pillar wall extends downwardly from the chamber top and such that the pillar opening is communicated with the pillar cavity; and a pillar cover, wherein the pillar cover defines a cover opening and is movably associated with the chamber top to be configurable between a first configuration and a second configuration, wherein when in the first configuration, the cover opening is communicated with the pillar cavity, and wherein when in the second configuration, the pillar opening is covered by the pillar cover.

2. The chamber of claim 1, wherein each of the first chamber side wall and second chamber side wall includes a plurality of peak corrugations which run transverse to the lengthwise direction of the chamber.

3. The chamber of claim 2, further including a plurality of cover positioning tabs, wherein the plurality of cover positioning tabs is are associated with the chamber top to be and located on the peak corrugations on either side of the chamber top.

4. The chamber of claim 1, wherein each of the first chamber side wall and second chamber side wall includes a plurality of valley corrugations which run transverse to the lengthwise direction of the chamber.

5. The chamber of claim 1, further including a plurality of cover positioning tabs, wherein the plurality of cover positioning tabs is are associated with the chamber top and located on either side of the chamber top.

6. The chamber of claim 1, wherein the pillar cover includes a centering slot, a retaining slot and a cover tab cavity, wherein the pillar cover is associated with the chamber top such that, when the pillar cover is in the first configuration, the retaining tab is located within the retaining slot, and when the pillar cover is in the second configuration, the centering tab is located within the centering slot and the retaining tab is located within the cover tab cavity.

7. The chamber of claim 1, wherein the pillar cover is slidably movable between the chamber first end and the chamber second end.

8. The chamber of claim 1, wherein the retaining tab is resiliently compressible between a compressed configuration and a decompressed configuration.

9. The chamber of claim 8, wherein when the pillar cover is configured in either the first configuration or the second configuration, the retaining tab is in the decompressed configuration, and wherein when the pillar cover is being configured between the first configuration and the second configuration, the retaining tab is compressed by the pillar cover to be in the compressed configuration.

10. A plastic chamber for collecting, receiving, detaining, or dispersing water when buried, the chamber comprising:

at least one support pillar, wherein the at least one support pillar includes at least one pillar wall which defines at least one pillar cavity;

a plurality of chamber ends;

a plurality of chamber side walls;

a chamber top, wherein the chamber top includes at least one pillar opening and wherein the chamber top, plurality of chamber ends and plurality of chamber side walls define a chamber internal cavity, and wherein the at least one support pillar extends downwardly from the chamber top, and wherein the at least one pillar opening is communicated with the at least one pillar cavity; and a pillar cover, wherein the pillar cover defines at least one cover opening and is movably associated with the chamber top to be configurable between a first configuration and a second configuration, wherein when in the first configuration the at least one pillar cavity is associated with the at least one cover opening to be uncovered, and wherein when in the second configuration, the at least one pillar opening is covered by the pillar cover.

11. The chamber of claim 10, wherein each of the plurality of chamber side walls includes a plurality of peak corrugations and valley corrugations which run transverse to a lengthwise direction of the chamber.

12. The chamber of claim 11, further including a plurality of cover positioning tabs, wherein the plurality of cover positioning tabs is are associated with the chamber top and located on the peak corrugations on either side of the chamber top.

13. The chamber of claim 10, further including a plurality of cover positioning tabs, wherein the plurality of cover positioning tabs are associated with the chamber top and located on either side of the chamber top.

14. The chamber of claim 10, further comprising a centering tab located adjacent a first chamber end of the plurality of chamber ends and a retaining tab located adjacent a second chamber end of the plurality of chamber ends.

15. The chamber of claim 14, wherein the pillar cover includes a centering slot, a retaining slot and a cover tab cavity, wherein when the pillar cover is in the first configuration, the retaining tab is located within the retaining slot, and when the pillar cover is in the second configuration, the centering tab is associated with the centering slot and the retaining tab is located within the cover tab cavity.

16. The chamber of claim 10, wherein the pillar cover is slidably movable between a first chamber end of the plurality of chamber ends and a second chamber end of the plurality of chamber ends.

17. The chamber of claim 10, further including a retaining tab located adjacent a second chamber end of the plurality of chamber ends, wherein the retaining tab is resiliently compressible between a compressed configuration and a decompressed configuration.

18. The chamber of claim 17, wherein when the pillar cover is configured in either the first configuration or the second configuration, the retaining tab is in the decompressed configuration, and wherein when the pillar cover is being configured between the first configuration and the second configuration, the retaining tab is compressed by the pillar cover to be in the compressed configuration.

19. A method of implementing a leaching chamber wherein the leaching chamber includes at least one hollow support pillar, wherein the at least one hollow support pillar includes at least one pillar wall which defines at least one pillar cavity;

a plurality of chamber ends;

a plurality of chamber side walls;

a chamber top, wherein the chamber top includes at least one pillar opening and wherein the chamber top, plurality of chamber ends and plurality of chamber side walls define a chamber internal cavity, and wherein the at least one support pillar extends downwardly from the chamber top, and wherein the at least one pillar opening is communicated with the at least one pillar cavity; and a pillar cover, wherein the pillar cover defines at least one cover opening and is movably associated with the chamber top to be configurable between a first configuration and a second configuration, wherein when in the first configuration the at least one pillar cavity is associated with the at least one cover opening to be uncovered, and wherein when in the second configuration, the at least one pillar opening is covered by the pillar cover, the method comprising:

obtaining the leaching chamber having the pillar cover, wherein the pillar cover is configured in the first configuration;

nesting a like chamber with the leaching chamber such that the at least one hollow support pillar of the like chamber is located within the pillar cavity of the leaching chamber;

transporting and/or storing the leaching chamber and nested like chamber;

denesting the leaching chamber and the like chamber;

configuring the pillar cover between the first configuration and the second configuration; and locating the leaching chamber and/or like chamber within a hole and covering the leaching chamber and/or like chamber with soil.

* * * * *